United States Patent [19]

Samborski et al.

[11] 4,209,762

[45] Jun. 24, 1980

[54] GROUND FAULT RECEPTACLE RESET BUTTON

[75] Inventors: Bruce A. Samborski, Bridgeport; Roy O. Wiley, Shelton, both of Conn.

[73] Assignee: Westinghouse Electric Corp., Pittsburgh, Pa.

[21] Appl. No.: 940,810

[22] Filed: Sep. 8, 1978

[51] Int. Cl.[2] ..... H01H 83/02

[52] U.S. Cl. ..... 335/18; 361/42

[58] Field of Search ..... 335/18; 361/42

[56] References Cited

U.S. PATENT DOCUMENTS

| | | | |
|---|---|---|---|
| 3,813,579 | 5/1974 | Doyle et al. | 335/18 |
| 4,001,652 | 1/1977 | Klein et al. | 335/18 |
| 4,010,431 | 3/1977 | Virani et al. | 335/18 |
| 4,034,266 | 1/1977 | Virani et al. | 335/18 |

*Primary Examiner*—Harold Broome

*Attorney, Agent, or Firm*—L. P. Johns

[57] ABSTRACT

A ground fault receptacle with improved reset test button for a ground fault receptacle for use in an outlet box characterized by a reset structure comprising a latch member releasably latching a contact carrying latching arm in the contact-closed position, the release structure also comprising a reset button including recess means, the latch member being seated in the recess means and being pivotally movable between latched and unlatched positions of the contact arm, and the reset structure comprising spring means engaging the latch member for holding the latch member in the latched position.

2 Claims, 11 Drawing Figures

GROUND FAULT RECEPTACLE RESET BUTTON

BACKGROUND OF THE INVENTION

1. Field of the Invention

This invention relates to a ground fault receptacle, and more particularly it pertains to an improved reset structure therefor.

2. Description of the Prior Art

A growing need for a receptacle with ground fault protection and having a compact size to enable insertion into a standard wall outlet box has resulted in the development of improvements in such a receptacle. One type of electrical receptacle assembly with ground fault protection is that shown in U.S. Pat. Nos. 3,813,579, 4,010,431, and 4,034,266.

Most prior receptacles with ground fault protection have involved problems involving performance characteristics relating to reliability. Some performance characteristics have involved inconsistencies in manufacturing tolerances which, in some cases, have caused increased false tripping.

Associated with the foregoing have been problems of design, resulting in increased costs due to unnecessary parts. By eliminating or combining certain parts, lower costs are achieved and, at the same time, inconsistencies in manufacturing tolerances are eliminated.

SUMMARY OF THE INVENTION

It has been found in accordance with this invention that the foregoing disadvantages may be overcome by the provision of an electric receptacle for mounting in a wall outlet box comprising socket means for receiving a plug of an electrical load, a first pair of cooperable contacts operable between open and closed positions, a second pair of cooperable contacts operable between open and closed positions, an operating mechanism including a contact arm carrying one contact of each pair of contacts and movable between open and closed positions of the contacts, a reset structure comprising a body, a shaft, and a latch member, the latch member releasably latching the arm in the closed position, bias means engaging the arm for urging the arm to the open position when the latch member is released, a pivot rib for the contact arm, the bias means urging the arm to pivot about the first pair of contacts during an initial movement of the arm when released to open the second pair of contacts and to then pivot about the pivot rib during a final movement of the arm to open the first pair of contacts, ground fault sensing means for monitoring the flow of current through the socket means, release means responsive to the fault sensing means for releasing the latch member from the contact arm to sequentially open the first and second pairs of contacts, the body of the reset structure comprising a reset button including recess means, the latch member being seated in the recess means and pivotally movable between latched and unlatched positions of the contact arm, the reset structure also comprising spring means for engaging the latch member to hold the latch member in the latched position, the shaft of the reset structure being an integral part of and extending from the reset button in the direction of movement of the reset structure, the latch member extending from the reset button in a direction substantially parallel to the shaft, the spring means being disposed between the shaft and the latch member for holding the latch member in the latched position and away from the shaft, the spring means comprising a leaf spring and having interfitting means, with the latch member for retaining the latch member in the recess means, and one of the latch member and spring having a projection and the other of the latch member and spring having a projection receiving recess.

The advantage of the device of this invention is that it reduces the cost of the parts involved and eliminates the problem of inconsistencies in tolerances which formerly caused false tripping.

DESCRIPTION OF THE PREFERRED EMBODIMENTS

Figure 1:
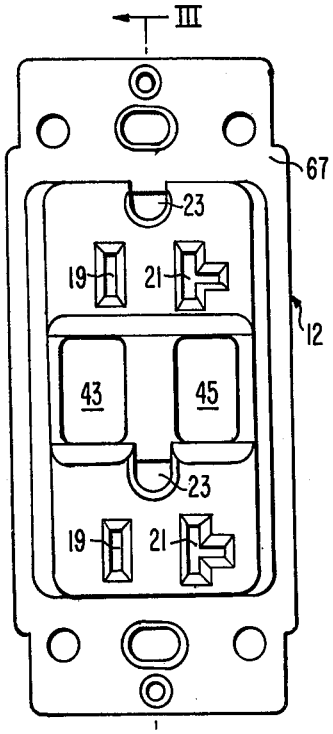
FIG. 1 is an elevational view of the front side of an electric receptacle in accordance with this invention.

An electric receptacle with ground fault protection of this invention is generally indicated at 12 in FIG. 1. It is connected by a single phase, two-wire line to an AC power source 13, the two-wire line consisting of a line conductor 15, and a grounded neutral conductor 17. Although a single phase, two-wire system is disclosed, it is understood that conventional single phase or polyphase circuits consisting of three or four wires may be used.

The conductors 15, 17 extend through the receptacle 12 to socket means which include a line terminal 19, a neutral terminal 21, and a ground terminal 23, to which a load 25, such as an electrical appliance, is detachably connected in a conventional manner. The receptacle 12 comprises ground fault detection means included within a broken line rectangle generally indicated at 27 (FIG. 11) and comprising a differential transformer including a toroidal core 29 and a ground fault sensor for trip circuit 31.

As disclosed in the prior art, such as U.S. Pat. No. 3,813,579, the line and neutral conductors 15, 17 pass through the toroidal core 29 thereby essentially comprising single turn primary windings of the core. A secondary winding 33 consists of a plurality of turns around the core and comprises a part of the trip circuit 31. The conductors 15, 17 also pass through a grounded neutral transformer 35 which is responsive to a fault on the load side of the differential transforer or core 29. The purpose and construction of the transformer 35 is set forth more particularly in the U.S. Pat. No. 3,930,187. Operating means 39 comprises a solenoid by which the contact arm is actuated from the closed to the open position thereby opening circuits between pairs of contacts 47, 49 contacts 51, 53, and contacts 55, 57.

The electromechanical components of the receptacle 12 are contained within the broken line rectangle 37 (FIG. 11) and comprise an insulative contact arm 41, a reset mechanism 43, and a test button 45.

Figure 3:
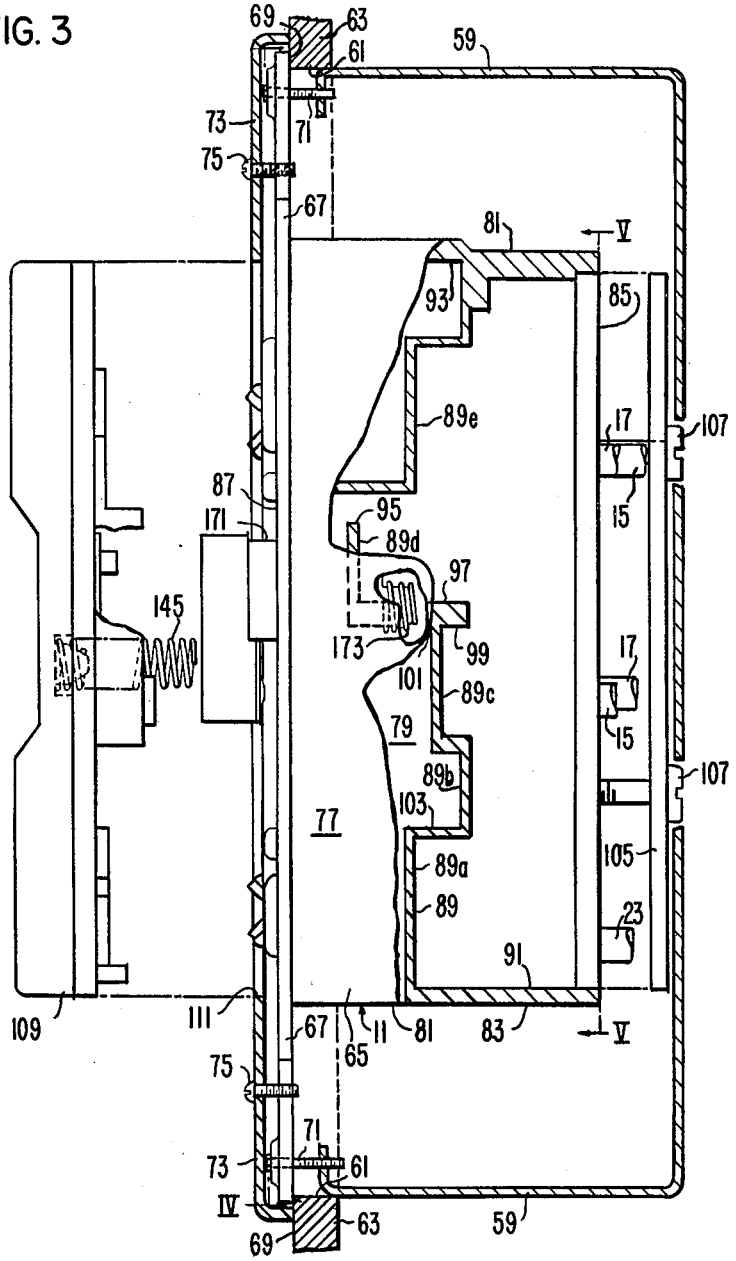
FIG. 3 is a vertical sectional view taken on the line III—III of FIG. 1 with some parts in exploded view and showing in addition the wall plate and wall outlet box in which the electric receptacle is disposed.

As shown in FIG. 3, the receptacle 12 is located within an outlet box 59 which is mounted within an opening 61 of a wall 63. The several components of the receptacle 12 are contained within an insulative housing 65 which is contained within the box 59 on a mounting plate 67 which is secured in place at peripheral areas 69 in contact with the wall 63 by mounting screws 71 extending between the plate and the outlet box 59. A cover plate 73 is mounted over the mounting plate 67 and is secured in place by screws 75.

Figure 11:
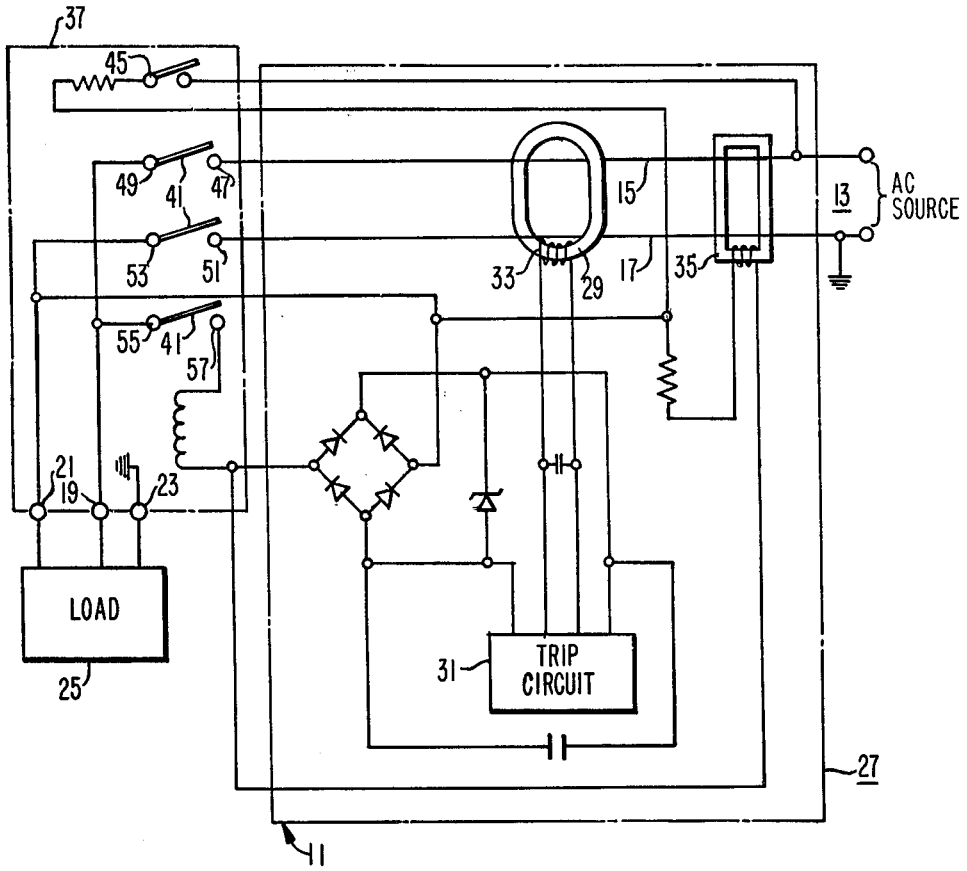
FIG. 11 is a wiring diagram of the receptacle assembly.

The insulative housing 65 is a rectangular member having opposite edge walls 77, 79 opposite end walls 81, 83, and opposite front and rear side openings 85, 87. A partition 89 extends across the interior of the housing 65 between opposite walls 77, 79, 81, 83 to divide the interior of the housing into separate compartments 91, 93 corresponding respectively to the broken line rectangles 37, 27 (FIG. 11). Spaced aperture means, such as an opening 95, are provided between opposite sides of the compartments 91, 93 to enable passage of wires such as the line and neutral conductors 15, 17.

As shown in FIG. 3, the partition 89 includes spaced longitudinal portions 89*a*, 89*b*, 89*c*, 89*d*, 89*e* which are disposed at various lateral positions between the front and rear side openings 85, 87. The partition 89 provides various recesses, such as recesses 97 and 99, on the side of the compartment 91, and recesses 101, 103 on the side of the compartment 93. By providing the partition 89 with partition segments 89*a–e* of different depths, the various recesses, such as recesses 97–103 having different locations with respect to the front rear side openings 85, 87, enable the assembly of the several parts comprising the electronic and mechanical components into a more compact arrangement than would be possible if the partition 89 were a single planar member extending across the interior of the housing between the opposite end walls 81, 83.

Moreover, the several recesses 97–103 enable the location of the several electronic and mechanical components in place with a minimum of mounting parts. The recesses hold several parts in place and prevent their shifting from position once they are seated in their predesigned locations. Accordingly, the partition performs the twofold purpose of separating the electronic and mechanical portions from each other to prevent debris from the mechanical side, such as fumes resulting from the arcing during opening and closing of the contacts, from contaminating the electronic side; and of conserving space in order to minimize the overall size of the housing 65 while providing an outlet receptacle with ground fault protection. In addition, the housing 65 includes a back cover 105 which is secured in place by spaced screws 107. The electronic or ground falut components 29, 31, 35 are contained within the second compartment between the partition 89 and the back cover 105. The so-called mechanical components 39, 41, 43, 45, 47–57, are contained within the compartment 91 between the partition 89 and the mounting plate 67.

Figure 2:
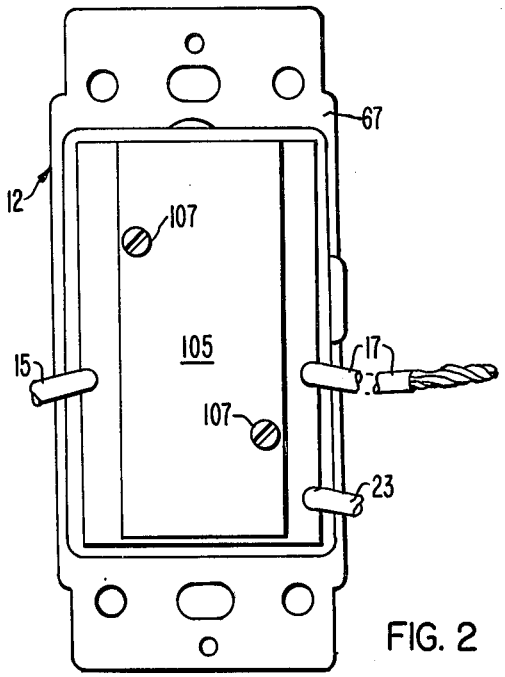
FIG. 2 is an elevational view of the rear side thereof.

In FIGS. 1 and 2 the front and rear sides of the receptacle 12 are shown in the assembled condition. The receptacle 12 is of the duplex type with one terminal above and another terminal below the reset and test buttons 43, 45. The reset and test buttons 43, 45 as well as the upper and lower receptacles or sockets 19, 21, 23 are disposed generally in the planar surface of the front side of the receptacle. A front cover insert 109, shown in exploded position (FIG. 3) with respect to the receptacle 12, is disposed within an opening 111 in the cover plate 73 and is provided with aligned openings each group for the terminals 19, 21, 23, as well as the reset and test buttons 43, 45.

Figure 5:
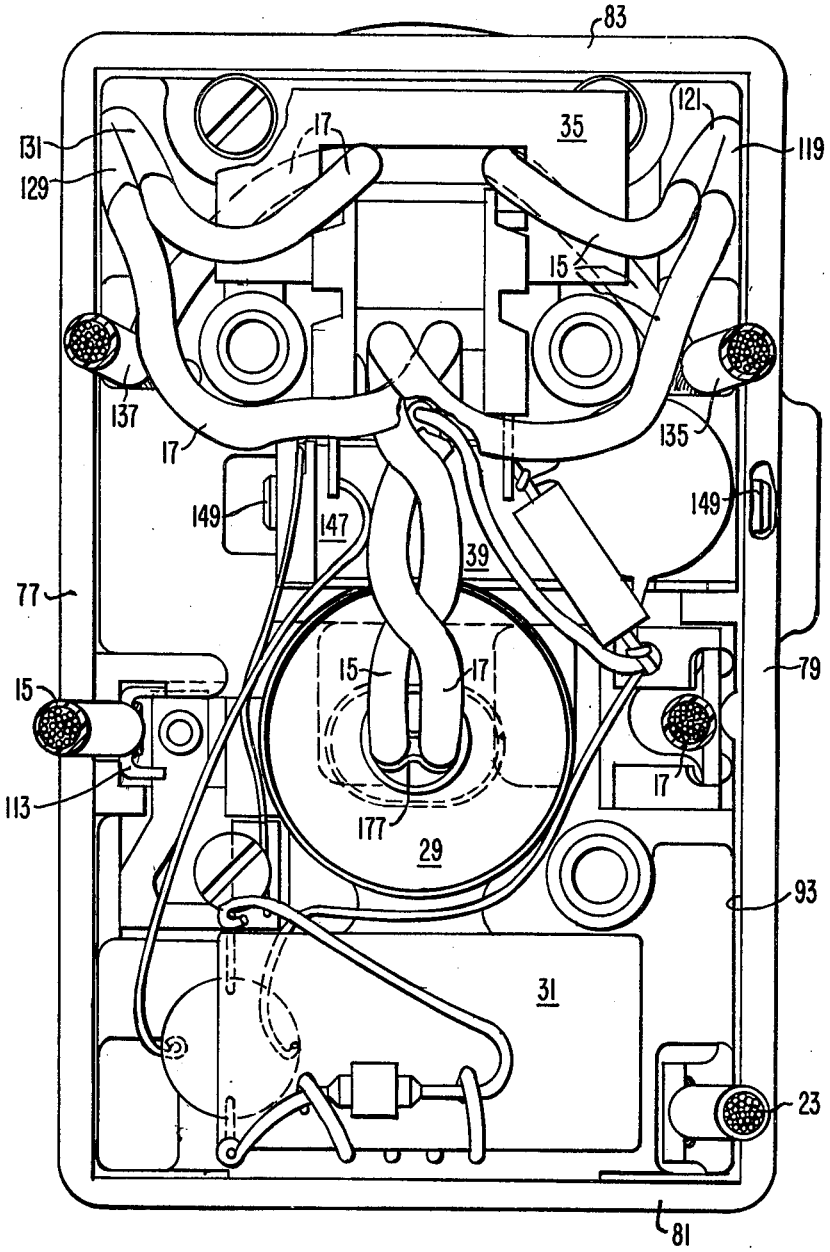
FIG. 5 is a vertical sectional view taken on the line V—V of FIG. 3.

As shown in FIG. 5, the electronic components comprising the ground fault protection portion of the receptacle 11 are contained within the compartment 93 between the partition 89 and the back cover 105. Those components comprise the toroidal core 29, the trip circuit 31, the operating means 39, and the grounded neutral transformer 35. Inasmuch as the detail description of these parts is set forth in U.S. Pat. Nos. 3,813,579 and 3,930,187, the description of those portions is limited to the parts that are essential to the operation of the invention disclosed herein.

Figure 4:
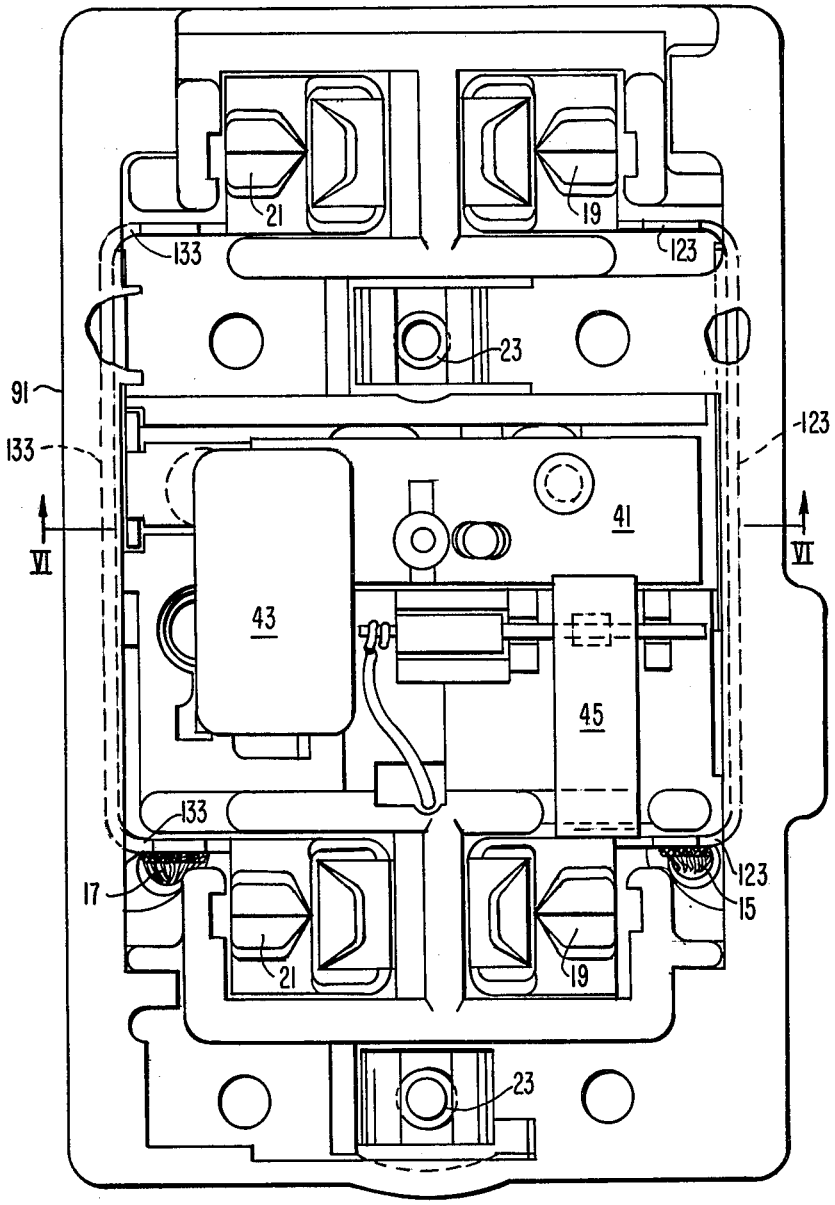
FIG. 4 is a vertical sectional view taken on the line IV—IV of FIG. 3.

The lead conductor 15 (FIG. 2) extends through the back cover 105 into the compartment 93 (FIG. 5) where it is connected to a contact bracket 113 which carries the current through an aperture in the partition 89 to contacts 47, 49 in the compartment 91. From there, the current moves through a contact plate 115 on the contact arm 41. The circuit continues through a shunt which is a continuation of the conductor 15 that passes through an aperture 117 in the partition 89, and through the core 29. The line conductor 15 extends from the core 29 (FIG. 5) to a splice 119 having a splice insulator 121 and then through the grounded neutral transformer 35 to a receptacle conductor 123 (FIG. 4) to which the conductor 15 is electrically secured such as by a spot weld (not shown). The receptacle conductor 123 extends between and is an integral part of the pair of line terminals 19 (upper and lower), whereby a circuit is maintained to both terminals.

In a similar manner, a circuit through the neutral conductor 17 extends through the back cover 105 (FIG. 2) into the compartment 93 (FIG. 5) where the conductor is secured, such as by a weld, to a contact bracket 125 which extends through an aperture in the partition 89 to the compartment 91 (FIG. 6) where the circuit passes through the closed contacts 53, 51. The movable contact 51 is mounted on a contact plate 127 on the contact arm 41. From there, the circuit passes through a shunt which is part of the neutral conductor 17 which extends through the aperture 117 and then through the core 29 into the compartment 93. The conductor 17 includes a splice 129 (FIG. 5) havng a splice insulator 131 and continues through the grounded neutral transformer 35 to a receptacle conductor 133 (FIG. 4) to which it is secured electrically, such as by a spot weld (not shown). Like the receptacle conductor 123, the conductor 133 is an integral part of both the upper and lower neutral terminals 21 between which it extends to provide a circuit through the lower terminal 21.

In the event that it is necessary to connect other receptacles having no ground fault protection units in the same circuit with the receptacle 12, a line conductor 135 (FIG. 5) and a neutral conductor 137 may be added by connecting said conductors at the junction of the line and neutral conductors 15, 17 to the receptacle conductors 123, 133, respectively, whereby feed through to the other receptacles is obtained.

The line and neutral conductors 15, 17 (FIG. 5) are twisted around each other for at least one complete cycle coaxially of each other at the portion of the conductors adjacent the toroidal core 29 in order to eliminate nuisance tripping caused by surge currents in the conductors. The twisted conductors having magnetic fluxes have a cancelling effect upon each other and therefore do not influence the coil of the core 29.

Figure 10:
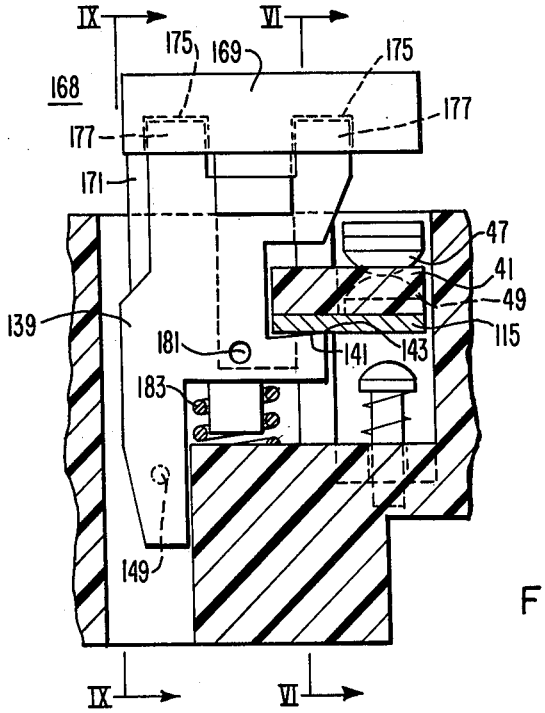
FIG. 10 is a fragmentary vertical sectional view taken on the line X—X of FIG. 6.
Figure 6:
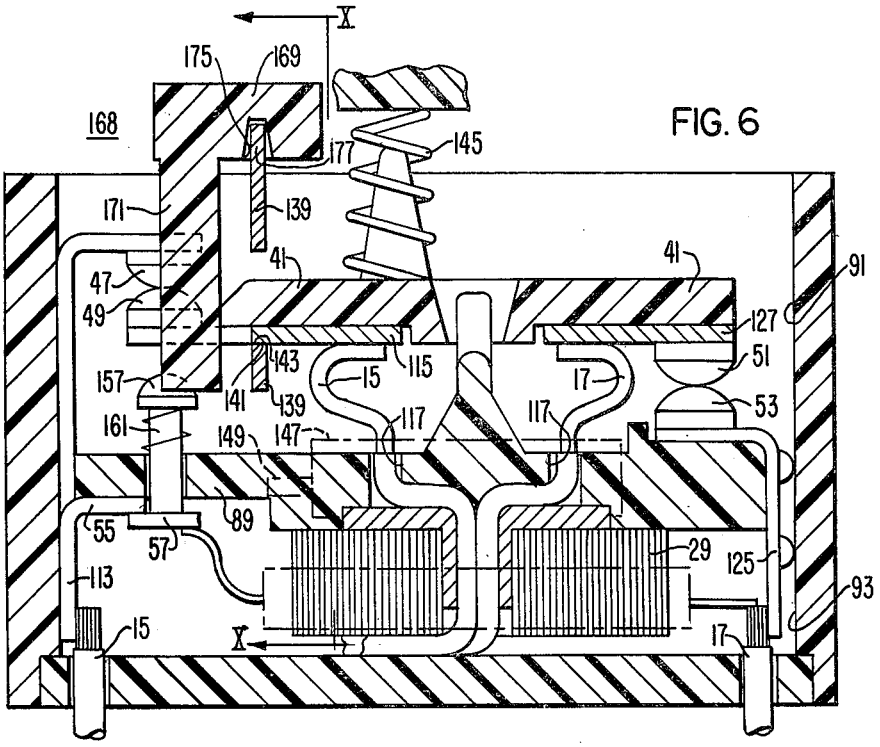
FIG. 6 is a vertical sectional view taken on the line VI—VI of FIG. 4 and showing the contact arm in the closed position.

As shown in FIGS. 6 and 10, the contact arm 41 is retained in the closed circuit position by a latch plate 139. For that purpose, the latch lever 139 comprises a shoulder 141 which engages an edge 143 of the contact plate 115, thereby holding the arm 41 in said position against the pressure of a coil spring 145 so that circuits through the line conductor contacts 47, 49 as well as through the neutral conductor contacts 51, 53 are closed. Under predetermined conditions of overload current the operating means 39 which includes a solenoid 147 having a plunger 149, is actuated against the latch lever 139 (FIG. 9) to move the lever to the position shown in FIG. 8 so that the coil spring 145 moves the contact arm 41 to the open position of the contact.

Figure 7:
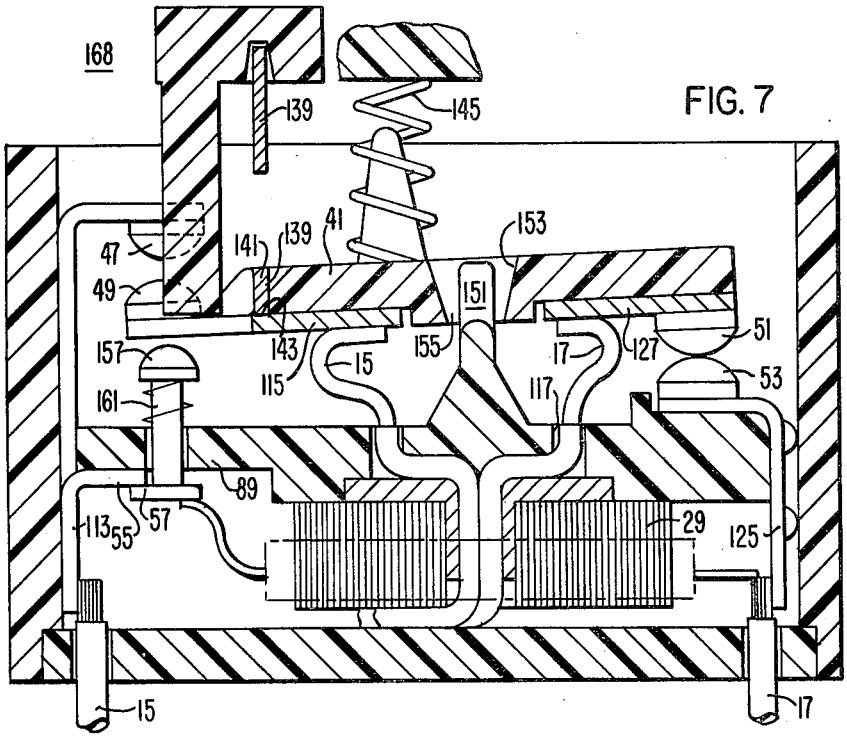
FIG. 7 is a fragmentary sectional view showing the contact arm in an intermediate position.

The contact arm 41 rotates about two different pivots during the movement of the arm between the closed and open positions as shown in FIGS. 6 and 7. One pivot point 151 extends through a hole 153 having tapered sides and having a lower side which provides a clearance 155 with said point in the closed position of the arm 41. When the latch lever 139 is moved to the unlatched position (FIG. 7), the clearance 155 around the pivot point 151 prevents the arm from contacing said point so that the spring 145 moves the plate counterclockwise initially around a pivot between the contacts 51, 53.

Figure 8:
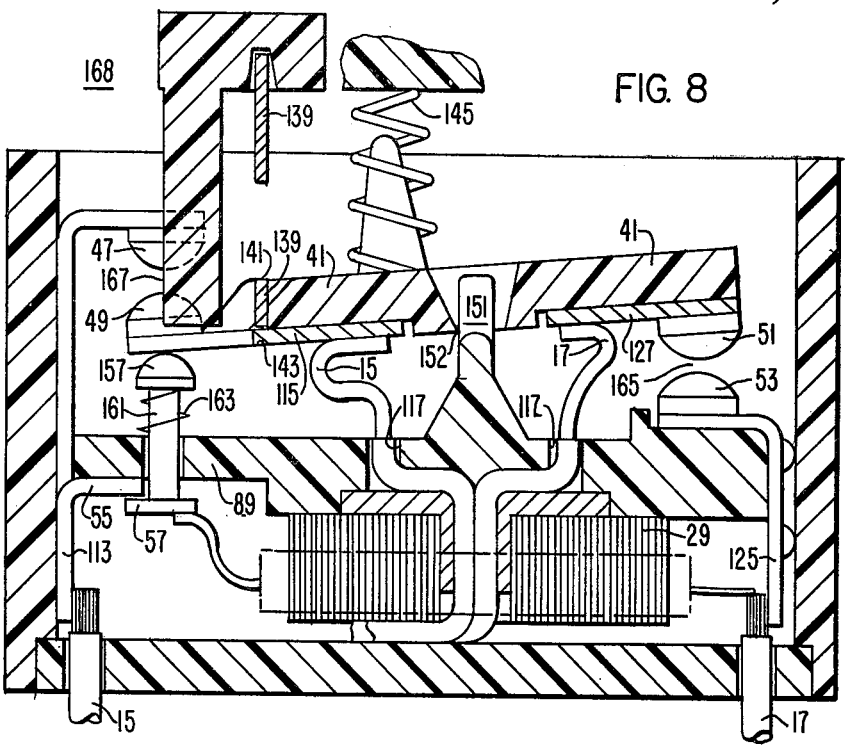
FIG. 8 is a view similar to FIG. 6 and showing the contact arm in the open position.
Figure 9:
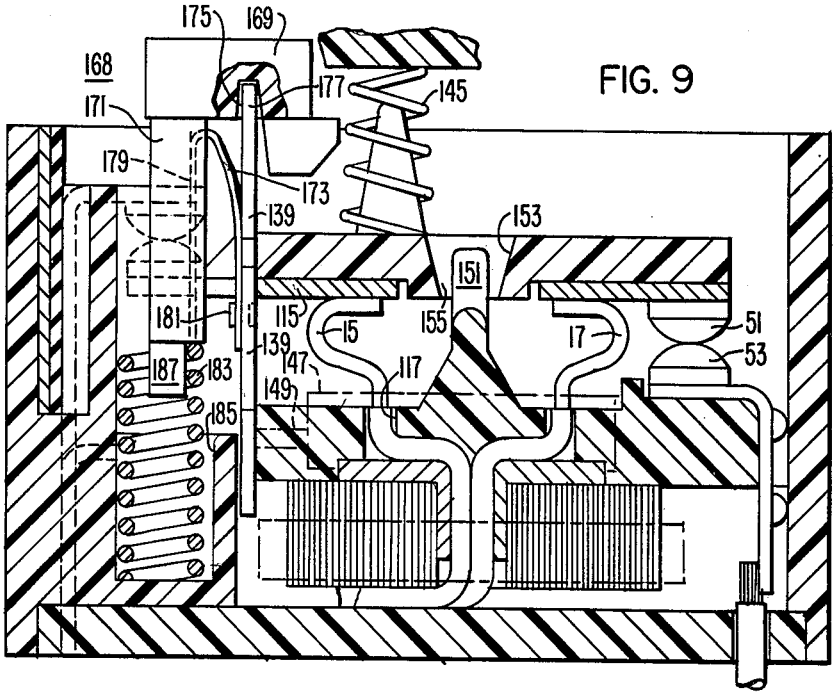
FIG. 9 is a vertical sectional view taken on the line IX—IX of FIG. 10.

Moreover, the contact plate 115 strikes a button 157 (FIG. 8) on a pin 161 and against a spring 163 so that the contact 57 is moved from the contact 55 which is a flange portion of the contact bracket 113. During that motion, the arm 41 touches the pivot point 151 at 152 which becomes a second pivot for the arm and continued movement of the arm causes the contacts 51, 53 to separate as shown in FIG. 8. Thus, the several pairs of contacts open and close sequentially and not simultaneously.

The sequential operation of the contact arm 41 provides for maintenance of a circuit through the trip circuit 31 during opening and closing of the contacts. So long as the receptacle 12 is properly wired, the neutral line will close before the hot line closes, because of the typical relay design, and there will be no problem in case of continuing ground fault. However, in case of reverse polarity, due to inadvertent wiring of the receptacle, the neutral line becomes the hot line and will close before the neutral line closes, which, without the third contact or contact means 55, 57, would not provide the protection against ground fault. Accordingly, the button 157 having a coil spring 163 to hold it in the upper position (FIG. 6) provides protection against ground fault in case of reverse polarity or miswiring of the receptacle, because it closes before both of the line and neutral contacts and energizes the trip circuit 31 as soon as the contacts 51, 53 close. In addition, in the open position the contacts 51, 53 have a smaller gap 165 (FIG. 8) than a gap 167 between contacts 47, 49. Moreover, the length of the control arm 41 between the pivot point 151 and the contact 51 is less than that between the pivot point 151 and the contact 49. Thus, when the arm 41 is moved to the closed position, the contacts 51, 53 closed before the contacts 47, 49.

In accordance with this invention, the receptacle comprises a reset structure generally indicated at 168 for manually resetting the receptacle to the closed circuit condition. The reset structure 168 comprises a manual reset button 169 having a shaft 171 integral with and depending downwardly therefrom. The reset structure 168 also comprises the latch lever 139 and bias means, such as a leaf spring 173, for urging the latch lever in the latched position (FIG. 9) with respect to the contact plate 115, whereby the several contacts are in the closed circuit position. As shown more particularly in FIGS. 6 and 10, the reset button 169 comprises a pair of notches 175 in which a pair of spaced upper end portions 177 are movably mounted. The leaf spring 173 serves the dual purpose of urging the latch lever 139 in a latched position and of preventing the lever from becoming dislocated from the notches 175. For that purpose, the leaf spring 173 is a U-shaped member, one leg portion of which is adjacent the lever 139 and the other leg portion of which is seated in a slot 179 in the shaft 171. The lower right-hand leg (FIG. 9) of the leaf spring 173 has an aperture through which a pin 181 projects from the spring 173. In the alternative, the pin and aperture may be in reverse positions. Suffice it to say, the pin and aperture combination in the leaf spring 173 and the lever 139 cooperate to retain the lever in the position shown in the notches 175. Thus, the latch lever 139 is swingable in the clockwise and counterclockwise directions about a pivot point in the notches 175.

The lower end of the shaft 171 is in abutment with the upper end of a coil spring 183 which is seated within a spring retaining well 185. The spring 183 thereby holds the reset structure 168 in the uppermost position, whereby the force of the spring is transmitted through the shoulder 141 (FIG. 10) to the edge 143 of the contact plate 115, which is thereby retained in the circuit closed position. To maintain alignment of the lower end of the shaft 171 with the spring 183, a projection 187 extends from the shaft into the upper end of the coil spring.

Accordingly, in accordance with this invention, the reset structure 168 comprises an improvement over the structure of prior embodiments because of its greater reliability and lower cost. The improved reset structure is comprised of three parts, including a molded reset button and integral shaft, as well as the latch lever and latch spring. As a result, the improved reset button has improved performance characteristics, such as the elimination of inconsistencies in manufacturing tolerances which caused frequent false tripping of the circuit interrupter portion of the receptacle.

What is claimed is:

1. An electric receptacle for mounting in a wall outlet box for connecting an electrical load to the conductors of a power source, comprising socket means for receiving a plug of an electrical load, a first pair of cooperable contacts operable between open and closed positions, a second pair of cooperable contacts operable between open and closed positions, an operating mechanism including a contact arm carrying one contact of each pair of contacts and movable between open and closed positions of the contacts, a reset structure comprising a latch lever releasably latching the arm in the closed position, bias means engaging the arm for urging the arm to the open position when the latch lever is released, a pivot rib for the contact arm, the bias means urging the arm to pivot about the first pair of contacts during an initial movement of the arm when released to open the second pair of contacts and to then pivot about the pivot rib during a final movement of the arm to open the first pair of contacts, ground fault sensing means for monitoring the flow of current through the socket means, release means responsive to the fault sensing means for releasing the latch lever from the contact arm to sequentially open the first and second pairs of contacts, the reset structure also comprising a reset button including recess means, the latch lever being seated in the recess means and being pivotally movable between latched and unlatched positions of the contact arm, the reset structure also comprising spring means engaging the latch lever for holding said lever in the latched position, the reset structure comprising a button and a shaft, the shaft being an integral part of and extending from the button in the direction of movement of the reset structure, the latch lever extending from the button in a direction substantially parallel to the shaft, and the spring means being disposed between the shaft and the latch lever for holding the latch lever in the latched position and away from the shaft.

2. The electric receptacle of claim 1 in which the spring means comprises a leaf spring, interfitting means for retaining the latch lever in the recess means, and one of the latch lever and leaf spring having a projection and the other of the latch lever and leaf spring having a projection-receiving recess.

* * * * *